US005542402A

United States Patent [19]

Lee et al.

[11] Patent Number: 5,542,402

[45] Date of Patent: Aug. 6, 1996

[54] POSITIVE CRANKCASE VENTILATION SYSTEM WITH A CENTRIFUGAL OIL SEPARATOR

[75] Inventors: George C. Lee, Novi; Fred P. Kunz, Grosse Ile, both of Mich.

[73] Assignee: Ford Motor Company, Dearborn, Mich.

[21] Appl. No.: 417,352

[22] Filed: Apr. 5, 1995

[51] Int. Cl.[6] ..... F02B 25/06

[52] U.S. Cl. ..... 123/573

[58] Field of Search ..... 123/572, 573, 123/574

[56] References Cited

U.S. PATENT DOCUMENTS

| | | | |
|---|---|---|---|
| 1,039,677 | 9/1912 | Theisen . | |
| 1,447,160 | 12/1921 | Thompson . | |
| 1,872,609 | 8/1932 | Schittke . | |
| 2,209,607 | 7/1940 | Nutting . | |
| 2,228,129 | 1/1941 | Stephano . | |
| 2,344,063 | 4/1941 | Waseige . | |
| 2,578,576 | 6/1948 | Morris . | |
| 2,578,577 | 8/1948 | Morris . | |
| 2,779,434 | 1/1957 | Smith . | |
| 3,234,716 | 2/1966 | Sevin et al. . | |
| 3,246,639 | 4/1966 | Oliver . | |
| 3,293,832 | 12/1966 | Loftheim . | |
| 3,406,504 | 10/1968 | Sylvan . | |
| 3,630,182 | 12/1971 | Lewis | 123/572 |
| 3,686,831 | 8/1972 | Libby . | |
| 3,720,045 | 3/1973 | Murphy . | |
| 4,597,372 | 7/1986 | Furukawa . | |
| 4,677,957 | 7/1987 | Valencia . | |
| 4,844,032 | 7/1989 | Groeger et al. . | |
| 5,063,882 | 11/1991 | Koch et al. . | |
| 5,113,836 | 5/1992 | Sweeten | 123/572 |
| 5,186,278 | 2/1993 | Ives et al. . | |
| 5,239,972 | 8/1993 | Takeyama et al. . | |
| 5,261,380 | 11/1993 | Romano . | |

OTHER PUBLICATIONS

SAE Paper (Feb. 1992) "Cosworth MBA Engine" Poole et al.

*Primary Examiner*—Marguerite Macy

*Attorney, Agent, or Firm*—Donald A. Wilkinson; Roger L. May

[57] ABSTRACT

A centrifugal oil separator assembly (36) mounts to the front cover (26) of an internal combustion engine (20) adjacent to the engine crankcase (34). The oil separator assembly (36) includes a first rotational member (42) that has turbo fan blades (52) and a second rotational member (56) that has centrifugal fan blades (60) and air seal grooves (66). A driven pulley (44) causes the oil separator assembly ( 36 ) to rotate. As it rotates, blowby gas is drawn through the centrifugal fan blades (60) where oil is separated from the gas and then through the turbo fan blades (52) which pushes the filtered gas into an air flow passage (28, 30) leading to the air intake system (31).

12 Claims, 2 Drawing Sheets

POSITIVE CRANKCASE VENTILATION SYSTEM WITH A CENTRIFUGAL OIL SEPARATOR

FIELD OF THE INVENTION

The present invention relates to oil separators used to separate oil from blowby gas in a positive crankcase ventilation (PCV) system.

BACKGROUND OF THE INVENTION

Some conventional positive crankcase ventilation (PCV) systems do not separate the oil from the gas that is in the engine blowby contained in the engine crankcase before recirculating it back into the air intake system of the engine. The blowby gas in the crankcase generally is mixed together in a gas/oil mixture. It is preferable to separate the oil from the engine blowby gas before feeding the blowby gas into the air intake system. It is desirable to aspirate the oil from the blowby gas in order to improve the oil economy of the engine by returning the separated oil to a sump to be re-used, and to reduce exhaust emissions by reducing the amount of oil that is circulated to the air intake system.

Automotive engine designers have used a variety of schemes to handle the flow of blowby gas originating in the crankcase and to separate the oil therefrom. Some of these systems employ centrifugal forces to separate the oil from the blowby gas. For those centrifugal types of oil separators already in the art, it is necessary to have a sealing type of mechanism between the rotating member and the structure that it is mounted to so that blowby gas that has not been through the centrifugal separator portion will not get into the clean gas that is flowing into the air induction system. This creates a concern with the wear and tolerances on typical seals, adding to the expense and complexity of the oil separator system.

Also, some oil separator systems rely solely on the vacuum pressure in the air induction system to operate, and may have difficulty operating optimally when vacuum pressure is low (i.e., at wide open throttle conditions). Further, an oil separator should be as compact as possible, to meet engine packaging requirements, and should require minimal power input from the engine to power it, while working adequately for all engine operating conditions.

SUMMARY OF THE INVENTION

In its embodiments, the present invention contemplates a centrifugal oil separator for use in an internal combustion engine having a crankcase containing gas from engine blowby, and an air induction system. The centrifugal oil separator comprises a rotatable member including a first fan portion having centrifugal fan blades with openings therebetween for receiving blowby gas from the crankcase; a second fan portion adjacent to and rotatable with the first fan portion and including booster fan blades with openings therebetween for receiving the gas from the first fan portion; and mounting means for mounting the rotatable member to the engine with the first fan portion exposed to the crankcase. The oil separator further comprises a pulley mechanism, coupled to the rotatable member, for causing rotation of the first and second fan portions; and drive means operatively engaging the pulley mechanism.

The present invention further contemplates a method of centrifugally separating oil from engine blowby gas contained in a crankcase of an internal combustion engine during engine operation. The method comprises: providing a first rotatable member having centrifugal fan blades exposed to the crankcase; providing a second rotatable member having booster fan blades co-axial with and adjacent to the centrifugal fan blades; and rotating the first and second rotatable members during engine operation such that the booster fan blades will draw the engine blowby gas through the centrifugal fan blades and, as the engine blowby gas passes through the centrifugal fan blades, the oil will be separated from the blowby gas.

Accordingly, an object of the present invention is to provide an oil separation system with two sets of fan blades, a first to separate the oil from the engine blowby gas coming from a crankcase and a second to force the gas to flow into the engine air intake system.

An advantage of the present invention is that the oil economy of the engine and the engine emissions are improved by reducing the amount of oil in the blowby gas that is recirculated to the air intake system, for all engine operating conditions, while maintaining a compact size for the oil separator.

A further advantage of the present invention is that the rotating member that causes the centrifugal force to separate the oil from the engine blowby includes a fan seal about its outer periphery to seal off the oil contaminated blowby in the crankcase from uncontaminated gaseous flow that has already passed through at least a portion of the oil separator.

A further advantage of the present invention is that the system includes a second set of fan blades that act as a flow booster to draw in the blowby gas from the crankcase even when the vacuum in the air induction system is low, such as at wide open throttle conditions.

DETAILED DESCRIPTION OF THE PREFERRED EMBODIMENTS

Figure 1:
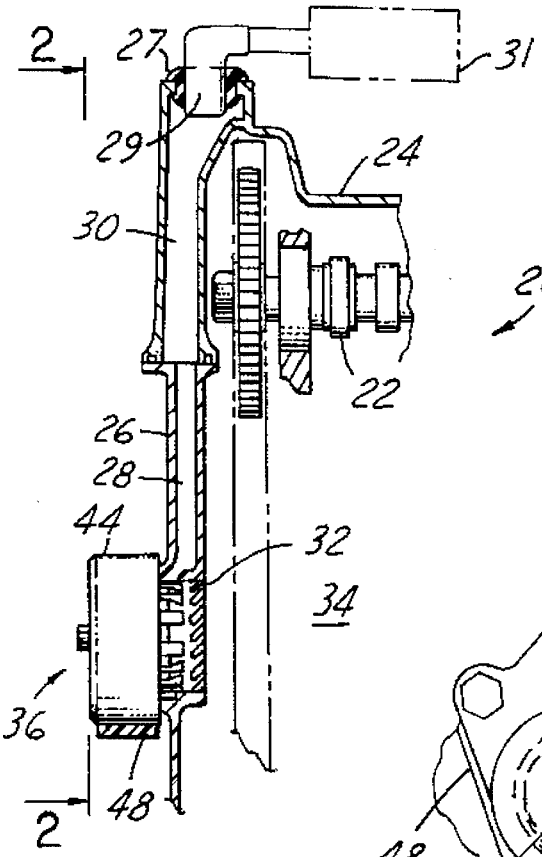
FIG. 1 is a schematic side view of a front portion of an engine, in partial section.
Figure 2:
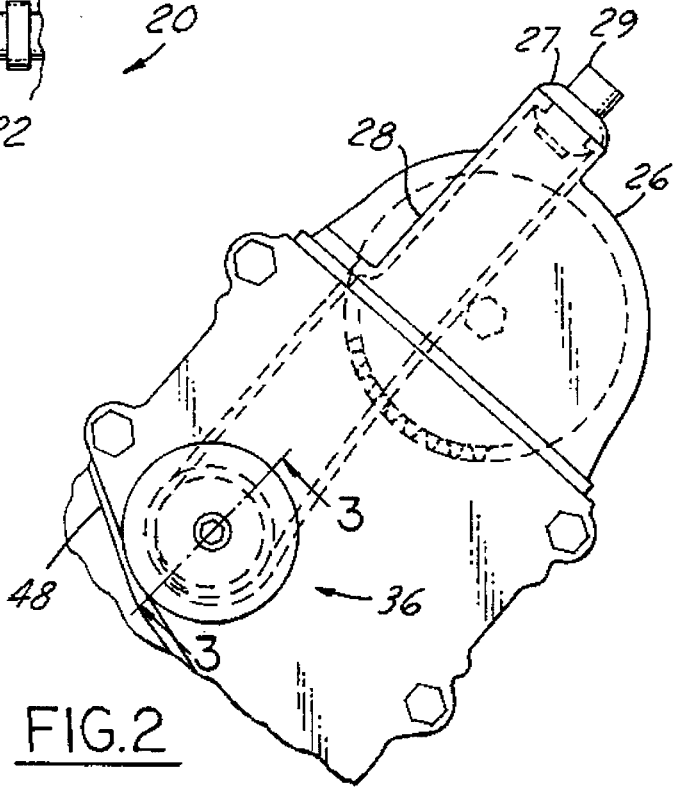
FIG. 2 is a front view of a portion of an engine, taken along line 2—2 in FIG. 1.
Figure 3:
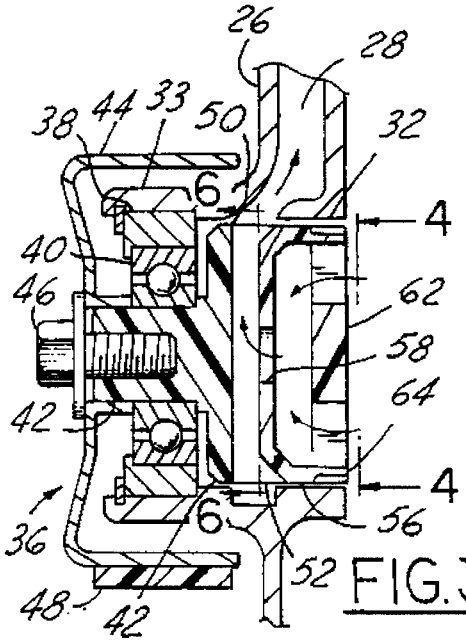
FIG. 3 is a sectional view taken along line 3—3 in FIG. 2, rotated 45 degrees counterclockwise.
Figure 4:
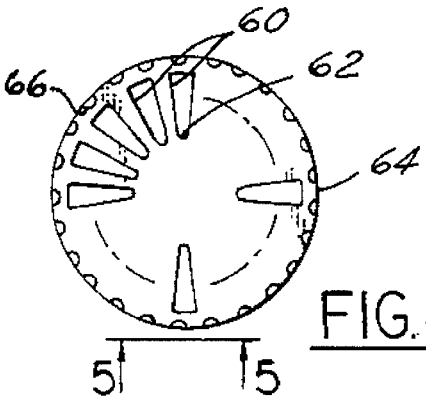
FIG. 4 is a view taken along line 4—4 in FIG. 3.
Figure 5:
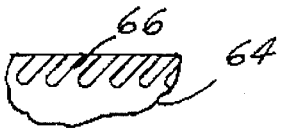
FIG. 5 is a view taken along line 5—5 in FIG. 4.
Figure 6:
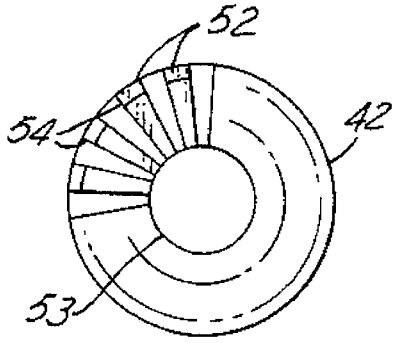
FIG. 6 is a sectional view taken along line 6—6 in FIG. 3.

FIGS. 1–6 illustrate a first embodiment of the present invention. An engine 20 includes a conventional camshaft 22 mounted within a conventional valve cover 24. The camshaft 22 is coupled to a conventional crankshaft, not shown. The valve cover 24 mounts on top of an engine front cover 26. A first air flow passage 28 is incorporated into the engine front cover 26, and a second air flow passage 30 is incorporated into the valve cover 24, aligned with the first air flow passage 28. The second air flow passage 30 leads to an opening which includes a rubber valve connector 27 for receiving a conventional PCV valve 29. The PCV valve 29 is, in turn, connected to a conventional air intake system 31 for the engine 20.

The engine front cover 26 includes a generally cylindrical opening 32 with an arm 33 protruding therefrom, adjacent to engine crankcase 34, for receiving an oil separator assembly 36. The oil separator assembly 36 mounts into the opening 32 by sliding a mounting member 38 into the cylindrical opening 32 until it abuts against a shoulder on the arm 33 of the front cover 26, and locking it in place.

The oil separator assembly 36 includes the mounting member 38 mounted about a bearing assembly 40 that is in turn mounted about a mounting arm portion of a first rotational member 42. Also mounted about the mounting arm portion of the first rotational member 42 is a pulley 44, that is secured to the first rotational member 42 by a bolt 46 screwed into a threaded hole in the mounting arm portion of first member 42. A drive belt 48 frictionally engages the pulley 44 and is coupled to the crankshaft, in a conventional manner, not shown, in order to rotationally drive the oil separator assembly 36. The drive belt 48 could engage the camshaft 22 or other rotating member in the engine rather than the crankshaft, if so desired, although the crankshaft is preferred.

The first rotational member 42 also includes a circular portion 50 having turbo fan blades 52 protruding therefrom. In the embodiment illustrated, there are 16 turbo fan blades 52, although other numbers of fan blades 52 can also be used. The turbo fan blades 52 extend radially outward from a central opening 53 and are generally equally spaced circumferentially about the circular portion 50. The outer portion 54 of each of the turbo fan blades 52 angles away from the circular portion 50 at about a 45 degree angle.

A second rotational member 56 has a generally cylindrical shape, with a chamfer on a first end that faces and nests in the outer portion 54 of the turbo fan blades 52. The first and second rotational members 42 and 56 are secured together by being press fit together, or by any other conventional means. This first end also includes a centrally located hole 58 aligned with the central opening 53 in the first rotational member 42.

A second end of the second rotational member 56 includes centrifugal fan blades 60 extending radially between a central disk portion 62 and an outer cylindrical portion 64. There are 16 fan blades 60 in the disclosed embodiment, although other numbers of fan blades 60 can be used. The fan blades 60 are generally equally spaced circumferentially about the second end of the second rotational member 56.

The outer cylindrical portion 64 includes a set of air seal grooves 66 along its outer surface. The air seal grooves 66 are generally equally spaced circumferentially about the cylindrical portion 64, and are angled about 45 degrees from normal to the second end. There is a small gap between the outer cylindrical portion 64 and the opening 32.

The operation of the centrifugal oil separator will now be described. As the engine operates, the pulley 44 is driven by the drive belt 48. The first and second members 42 and 56 are caused to rotate to give the rotational motion needed to create the centrifugal force for the oil separation and vacuum booster. Preferably, the diameter of the pulley 44 is such that when affixed in a typical belt and pulley system coupled to an engine crankshaft, the oil separator assembly 36 will be driven at about 2 to 3 times the crankshaft speed, rather than at the camshaft speed or even the crankshaft speed to assure adequate rotational speed to perform its functions for all engine operating conditions.

The centrifugal fan blades 60 use the centrifugal force created by the rotation to separate the oil from the engine blowby gas as it flows into the separator assembly 36 and let the oil drain directly back into an oil sump, not shown, in the crankcase 34. The turbo fan blades 52 create a vacuum flow booster behind the centrifugal fan blades 60 and push the filtered gas into the air flow passage 28.

Thus, the centrifugal flow booster improves flow driving power, especially under higher engine speeds, when there is less manifold vacuum in the air induction system 31, to ensure adequate flow of the gas into the air induction system 31 for all engine conditions. This allows the size of assembly to be minimized. Additionally, with the flow passage 28 in the engine front cover 26, the potential for water condensation can be minimized.

The rotation of the second rotational member 56 also causes rotation of the air seal grooves 66 relative to the opening 32. The small fan type of grooves 66 are angled such that the rotation causes a small amount of flow of gas that otherwise would enter the air flow passage 28 to go back out into the crankcase 34 through the gap. This effectively makes an air seal between the second rotational member 56 and the opening in the front cover 26 because the small flow back prevents any crankcase gas mixture that has not gone through the centrifugal fan blades 60 from entering the oil separator assembly 36 here. The effective air seal is much less expensive and less complex than trying to make a conventional seal at this gap between rotating parts.

Figure 7:
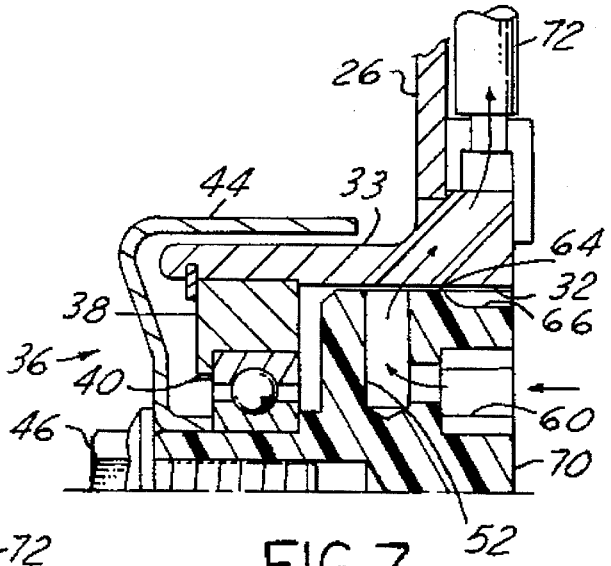
FIG. 7 is a view similar to FIG. 3, showing a second embodiment of the present invention.

A second embodiment is shown in FIG. 7. It is similar to the first embodiment, except the first and second rotational members of the first embodiment are now a single integral rotational member 70. This configuration changes the flow of gas through the flow booster somewhat, although generally it operates in the same way. A further change is that a flow tube 72 is mounted inside the engine front cover 26 rather than incorporating a passage within the front cover.

Figure 8:
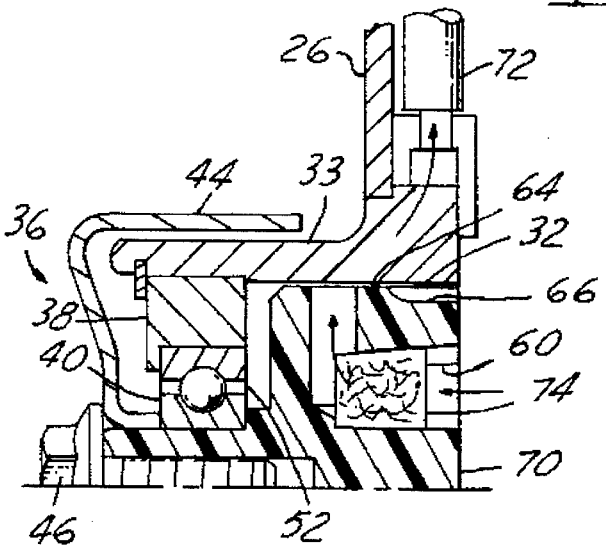
FIG. 8 is a view similar to FIG. 7, showing a third embodiment of the present invention.

A third embodiment is shown in FIG. 8. This embodiment is essentially the same as the second embodiment, except that a space is provided for the insertion of a metal foam ring 74. It is located in the oil separator assembly 36 between the centrifugal blades and the turbo fan blades to give more efficiency in separating the oil from the blowby gas.

As a further embodiment, the PCV valve 29, as shown in the first embodiment, can be eliminated and the filtered blowby directly fed into the air intake system 31 rather than having the blowby flow through the PCV valve 29 before it enters the air intake system 31, if so desired.

While certain embodiments of the present invention have been described in detail, those familiar with the art to which this invention relates will recognize various alternative designs and embodiments for practicing the invention as defined by the following claims.

We claim:

1. A centrifugal oil separator for use in an internal combustion engine having a crankcase containing gas from engine blowby, and an air induction system, the centrifugal oil separator comprising:

a rotatable member including a first fan portion having centrifugal fan blades with openings therebetween for receiving blowby gas from the crankcase, a second fan portion adjacent to and rotatable with the first fan portion and including booster fan blades with openings therebetween for receiving the gas from the first fan portion, and mounting means for mounting the rotatable member to the engine with the first fan portion exposed to the crankcase;

a pulley mechanism, coupled to the rotatable member, for causing rotation of the first and second fan portions; and drive means operatively engaging the pulley mechanism.

2. The centrifugal oil separator of claim 1 wherein the rotatable member is shaped to provide a gap between the first fan portion and the engine, and the rotatable member further includes a plurality of air seal grooves located on the first fan portion between the first fan portion and the engine, within the gap, whereby rotation of the first fan portion will cause a flow of gas through the gap into the crankcase.

3. The centrifugal oil separator of claim 2 further including a metal foam ring, wherein the rotatable member includes a cavity located between the centrifugal and the booster fan blades that receives the metal foam ring therein.

4. The centrifugal oil separator of claim 1 further including a metal foam ring, wherein the rotatable member includes a cavity located between the centrifugal and the booster fan blades that receives the metal foam ring therein.

5. The centrifugal oil separator of claim 1 wherein the rotatable member is comprised of two pieces, a first piece including the first fan portion and a second piece including the second fan portion and the mounting means.

6. The centrifugal oil separator of claim 1 wherein the engine includes a front cover having an air flow passage leading to the air induction system, and the rotatable member is mounted in the front cover such that the booster fan blades are aligned to push gas into the air flow passage when rotating.

7. The centrifugal oil separator of claim 6 wherein the air flow passage includes a means for receiving a positive crankcase ventilation valve.

8. A method of centrifugally separating oil from engine blowby gas contained in a crankcase of an internal combustion engine during engine operation, the method comprising:

providing a first rotatable member having centrifugal fan blades exposed to the crankcase;

providing a second rotatable member having booster fan blades co-axial with and adjacent to the centrifugal fan blades; and rotating the first and second rotatable members during engine operation such that the booster fan blades will draw the engine blowby gas through the centrifugal fan blades and as the engine blowby gas passes through the centrifugal fan blades, the oil will be separated from the blowby gas.

9. The method of claim 8 further comprising the steps of:

providing sealing grooves around the periphery of the first rotatable member; and driving air along the sealing grooves into the crankcase while the first rotatable member is rotating.

10. The method of claim 9 further comprising the steps of:

providing a metal foam ring between the centrifugal fan blades and the booster fan blades; and pulling the gas through the metal foam ring after it passes through the centrifugal fan blades.

11. The method of claim 8 further comprising the steps of:

providing a metal foam ring between the centrifugal fan blades and the booster fan blades; and pulling the gas through the metal foam ring after it passes through the centrifugal fan blades.

12. A positive crankcase ventilation system in an internal combustion engine having an air induction system and a crankcase containing engine blowby gas during engine operation, the system comprising:

an engine front cover mounted to the engine and including a mounting hole, exposed to the crankcase, a front cover arm surrounding the hole, and an air flow passage having one end exposed to the hole;

a rotatable member including a first fan portion having centrifugal fan blades with openings therebetween for receiving blowby gas from the crankcase, a second fan portion adjacent to and rotatable with the first fan portion and including booster fan blades with openings therebetween for receiving the gas from the first fan portion, mounting means for mounting the rotatable member to the arm of the engine front cover with the first fan portion exposed to the crankcase, and a plurality of air seal grooves located on the first fan portion between the first fan portion and the mounting hole of the engine front cover whereby rotation of the first portion will cause a flow of gas along the grooves into the crankcase;

means for rotationally mounting the rotational member in the hole of the front cover; and a driving mechanism for causing the rotational member to rotate during engine operation.

* * * * *